US006431387B2

(12) United States Patent
Piehler

(10) Patent No.: US 6,431,387 B2
(45) **Date of Patent: *Aug. 13, 2002**

(54) FLAT-BOTTOMED TANK AND METHOD FOR FITTING IT WITH A LEAK-PROOF COATING

(75) Inventor: Andreas Piehler, Dessau (DE)

(73) Assignee: UTEK Umweltschutztechnologien GmbH, Oranienbaum (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/297,119

(22) PCT Filed: Apr. 14, 1999

(86) PCT No.: PCT/EP99/02517

§ 371 (c)(1),
(2), (4) Date: Jun. 2, 1999

(87) PCT Pub. No.: WO99/54236

PCT Pub. Date: Oct. 28, 1999

(30) Foreign Application Priority Data

Apr. 22, 1998 (DE) ..... 298 07 285 U

(51) Int. Cl.[7] ..... B65D 25/14; B65D 90/04

(52) U.S. Cl. ..... 220/495.01; 52/169.7; 52/247; 52/249; 52/273; 220/4.12; 220/565

(58) Field of Search ..... 220/4.12, 4.13, 220/1.6, 23.9, 62.22, 565, FOR 114, FOR 115, FOR 157, FOR 162, FOR 173, FOR 182, 495.01, 415.06, 495.08; 52/247, 249, 169.7, 273

(56) References Cited

U.S. PATENT DOCUMENTS

| | | | | |
|---|---|---|---|---|
| 3,288,346 A | * | 11/1966 | Peppler | 220/62.2 |
| 3,460,705 A | * | 8/1969 | Green | |
| 4,068,777 A | * | 1/1978 | Humphrey et al. | 220/565 |

(List continued on next page.)

FOREIGN PATENT DOCUMENTS

| | | |
|---|---|---|
| CH | 484 798 | 1/1970 |
| CH | 617 148 | 5/1980 |
| DE | 1974383 | 9/1967 |
| DE | 67 51 479 | 9/1968 |
| DE | 6751479 | 2/1969 |
| DE | 7209764 | 4/1973 |
| DE | 36 22 593 | 11/1988 |
| DE | 38 34 656 | 12/1989 |
| DE | 90 12 360 | 12/1990 |
| DE | 196 21 169.6 | 5/1996 |
| EP | 0 069 303 | 1/1983 |
| EP | 0 571 868 | 12/1993 |
| EP | 0 705 771 | 4/1996 |
| EP | 0 761 567 | 8/1996 |

*Primary Examiner*—Lee Young
*Assistant Examiner*—Joseph C Merek
(74) *Attorney, Agent, or Firm*—Collard & Roe, P.C.

(57) ABSTRACT

The invention relates to an above-ground storage tank having a leakage protection lining for storing media posing a hazard to water, and to a process for equipping and particularly refitting an existing above-ground storage tank with a lining protecting it against leakage. The lining can be mounted permanently and vacuum tight on the walls of the tank. A medium-resistant foil almost completely covers the tank bottom and extends up into the lower zone of the inner side of the tank wall. This foil is secured around the outer limitation of the tank bottom by a clamping device. An insert covers the tank bottom and extends up to the clamping device.

18 Claims, 5 Drawing Sheets

U.S. PATENT DOCUMENTS 4,117,947 A * 10/1978 Androulakis ..... 220/901
4,344,543 A * 8/1982 Hoffman ..... 220/565
4,860,916 A * 8/1989 Winters ..... 220/565 X
4,865,213 A * 9/1989 Kruger ..... 220/4.16 X
4,939,833 A * 7/1990 Thomas ..... 220/565
4,941,589 A * 7/1990 Chen ..... 220/1.6
RE33,421 E * 11/1990 Bachman ..... 220/4.12
5,179,971 A * 1/1993 Jackson ..... 220/506 X
5,209,364 A * 5/1993 LaPoint, Jr. ..... 383/109
5,269,436 A * 12/1993 Bachman ..... 220/62.2 X
5,558,245 A * 9/1996 White ..... 220/565
5,597,948 A * 1/1997 Sharp ..... 220/565 X
5,762,222 A * 6/1998 Liu ..... 220/1.5
5,927,534 A * 7/1999 King et al. ..... 220/224
5,971,185 A * 10/1999 Schutz ..... 220/1.6
5,988,493 A * 11/1999 Clougherty ..... 220/62.22 X

* cited by examiner

FLAT-BOTTOMED TANK AND METHOD FOR FITTING IT WITH A LEAK-PROOF COATING

The invention relates to an above-ground storage tank with a lining protecting it against leakage, for storing media posing a hazard to water, as well as to a process for equipping, and particularly for later equipping an above-ground storage with a lining protecting it against leakage.

Above-ground storage tanks consist of steel or reinforced concrete and are employed mainly for storing fuels, mineral oils, acids, lyes, solvents or the like.

Both single-wall and double-wall above-ground storage tanks are employed in practical life. For reasons of environmental protection, it is necessary to monitor above-ground storage tanks for leakage particularly within the zone of the tank bottom. To permit such monitoring it is necessary in connection with single-wall storage tanks to later equip such tanks with an additional lining protecting such tanks against leakage. It is known also, for example, to weld in an additional intermediate bottom made of metal and to evacuate the chamber so formed, or to maintain such chamber at a pressure below atmospheric pressure so that leakages occurring can be detected in due time through monitoring of the pressure difference. A process for producing a double-walled tank from a single-wall tank is described in EP 0 705 771 A1. Flat sections are welded to the inner walls of the tank and sheet metal plates are welded to the flat sections. It is known from EP 0 069 393 B1 to insert in existing single-walled, ground-installed tanks for the purpose of leak control a plastic nap sheet and an inner covering made of plastic in order to form between the walls of the tank and the stored material an intermediate space that can be monitored. Since the plastic sheet is electrically nonconductive, it is proposed also to arrange as spacing means a metal foil, onto which an electrically conductive, fiber-reinforced layer of epoxide is sprayed. The use of an electrically conductive polyurethane sheet for producing flexible inserts for containers is described in EP 0 571 868 A1. Said linings require much expenditure in terms of their manufacture and installation. Intermediate or additional bottoms, for example, are produced from metal and mounted by welding in the interior of the tank.

When flexible plastic foils are employed, the entire inner space of the tank is always lined, as far as we know, with a so-called second wall.

It is known from DE 38 34 656 C1 that a lower foil is arranged in an oil-collecting tub consisting of a bottom plate made of concrete and walls consisting of bricks or concrete, with the wall zones of such foil extending up to the top edge of the walls, whereby the foil is retained on the top edge of the walls by means of contact pressure-exerting rails. The lining of tanks by means of a double bottom made of plastic with application of a napped foil in association with a plastic layer based on epoxide resin is described in DE 36 22 593 C2. Both layers also slightly extend up the side wall of the tank, whereby fastening of the napped foil on the wall of the tank is effected by the applied coating of epoxide resin.

An inside lining for a gasoline tank is known from DE 196 21 469 A1, said lining consisting of a two-sided foil. The foil is retained in the dome of the tank by means of a clamping ring.

However, lining of the entire inside space of a tank for forming a double wall is very cost-intensive.

It is known from practical application that joining of the foil with the walls of the tank poses problems because the joints have to be medium-and vacuum-tight. Especially in connection with storage tanks made from steel, it has to be taken into account that such tanks are installed outdoors and exposed to considerable temperature variation. In addition, changing levels of the fluids in the containers have an effect on the expansion behavior of the container material as well.

A storage container for fluids, in particular for fuel oil, is known from De GM (design or utility patent) 67 51 479. In the corner regions, said storage container has connection ducts separated by baffle plates for generating a vacuum and for monitoring the latter. A plastic tub is inserted in the storage container, such tub resting on sheet metal plates serving as spacing means. The marginal zones of the plastic tub are joined with side walls of the container by gluing or welding and, if need be, additionally secured by pressure strips not shown. The height of the plastic tub is designed in such a way that the sludge deposition zone is covered. The container consists of metal because trapezoidal sheet metal plates have to be welded into the container. It has to be mentioned also that the pressure strips can be pressed onto the welded joints or glued joints by screws, with elastic substrate inserted in between. Said screws, however, exclusively serve the purpose of generating the contact pressure force required in the course of the gluing or welding process. The storage container is designed in the form of a brick and fitted with a plane bottom and a plane cover plate. Such a container is not a flat-bottom or above-ground storage tank in the actual sense of the term. Since the lining protecting against leakage consists of a rigid and stable, prefabricated plastic tub, the cover of the container has to be removable, so that the plastic tub can be installed. The manufacturer of a separate plastic tub is connected with high costs. Exactly fitting plastic tubs have to be manufactured for different storage container dimensions. This solution is entirely unsuitable for above-ground (flat-bottom) storage tanks, in particular when such tanks are re-equipped later.

The invention was based on the problem of creating an above-ground storage tank with a lining protecting against leakage that can be manufactured and installed in a simple way; which can be mounted permanently medium- and vacuum-tight on the wall of the tank; and which satisfies the requirements with respect to leakage monitoring. Furthermore, the goal was to provide a suitable process particularly for equipping existing above-ground storage tanks later with a lining protecting against leakage.

The leakage protection lining for above-ground storage tanks consists of at least one pressure-stable, cavity forming insert, and a medium-resistant plastic sheet resting on said insert. Before the leakage protection lining is mounted as a later-fitted equipment, it is necessary to examine whether the bottom of the tank satisfies the tightness requirements. If necessary, a corrosion-inhibiting coating of paint is applied to the bottom of the tank as an additional measure, or the bottom of the tank is coated with a liquid plastic. After tightness of the bottom of the tank is assured, the insert is placed on said bottom, such insert in the known way consisting of, for example, a plastic grid or a napped foil. The medium-resistant foil can be provided with cavity-forming elements such as, for example, naps or the like on its underside as well.

Also, it may be useful in certain cases of application to arrange an additional foil between the bottom of the tank and the insert. Important is that a suitable intermediate s pace for leakage monitoring is formed between the two foils or the foil resting on the insert and the bottom of the tank. According to the invention, two different sites of fastening or mounting are proposed for joining the foil with the inner side of the tank in a medium-tight manner. The required clamping device may be installed either on the inner side of the tank wall with a small spacing from the bottom of the tank, such spacing preferably being in the range of 100 to 500 mm, or on the outer limitation of the tank bottom, thus in the region of the transition between the tank bottom and the tank wall. The bottom of the tank can be designed as a plane or an arched or curved surface. The clamping device consists of a stationary part like a flange extending all around, which flange may be formed also by a plurality of segments, or it consists of bolts; the latter being arranged at defined spacings and projecting inwardly. The stationary parts form the actual mounting and are secured on the inner side of the tank by welding or gluing. The movable part of the clamping device is formed by the clamping rails, the elastic sealing strips and the tensioning means. If the mounting site is located above the tank bottom, the outer dimensions of the foil resting on the insert are only slightly larger than the dimensions of the bottom area of the tank, whereby the foil should literally project beyond the area of the bottom of the tank by up to about 500 mm. The foil consequently extends only up into the lower zone of the inner side of the tank walls. In said zone, which is located about 100 to 500 mm above the bottom of the tank, the foil is secured all around on the inner side of the tank walls by means of a suitable clamping device. With a lateral arrangement of pipelines for leakage monitoring near the bottom of the tank, the insert should still extend up to below the clamping device. As a rule, above-ground storage tanks are made of steel, and either rest on the ground, or they arranged on supports with a small spacing from the ground. The number of above-ground storage tanks manufactured from reinforced concrete is relatively low as compared to above-ground storage tanks fabricated from steel. It is not possible in connection with above-ground storage tanks to visually inspect the bottom of the tank for tightness. So as to prevent leakage from penetrating the soil, it is only known heretofore to weld a new intermediate bottom, e.g. made of steel into the above-ground storage tank, and to arrange a leakage monitoring system. As compared to the above, the proposed solution is substantially more favorable in terms of cost, and requires only lower installation expenditure. Since the foil is secured in the lower zone of the above-ground storage tank, thus below the lower permissible level of the fluid that has to be maintained, hardly any problems arise on the walls of the tank due to varying thermal expansions of the materials. Thus, the foil can be permanently and pressure-tight mounted on the inner wall of the tank with relatively simple means. The mounting elements are constantly in contact with the fluid being stored except for brief periods, for example, when the tank is cleaned.

It may be even sufficient in certain cases of application if only the bottom of the tank is provided with a lining protecting against leakage. A flange extending all around is preferably employed as the retaining means, such flange being welded to the outer limitation of the tank bottom, to the bottom of the tank, and to the walls of the tank. The flange extending all around should be made from the same material as the tank. Important is that the materials employed for the tank and for the flange do not differ from each other with respect to their coefficients of expansion.

If the mounting elements for securing the lining protecting against leakage are arranged in a zone where the level of the fluid is constantly changing, problems would arise with respect to the tightness of the wall mounting due to considerable variation of the outside temperature and differences in material expansion conditioned by such variations. A suitable clamping device consists of steel fastening bolts arranged at the same level with defined spacings between each other, as well as clamping rails which are pluggable onto said bolts, whereby elastic sealing strips extending all around are arranged between the foil and the inner side of the tank walls. In the case of above-ground storage tanks manufactured from steel, the bolts are welded to the inner side of the tank walls, and with above-ground storage tanks from reinforced concrete; the bolts are glued into the reinforced concrete wall. The sealing strips may be coated with adhesive or a sealing compound on one or on both sides. In order to obtain the tight connection required between the foil and the inner side of the tank walls, a contact pressure has to be applied as uniformly as possible to the clamping rails all around. The length of the individual clamping rails should be dimensioned in such a way that they can be plugged onto a plurality of bolts disposed adjacent to each other, or that they can be plugged together or into one another. Also, they may be connectable among each other by means of a coupling piece. The clamping rails have matching oblong holes in order to be plugged onto the bolts. Important is that no free space exists between two adjacent clamping rails.

Another design variation of the clamping rails consists in, for example, an exactly fitted compensation rail is additionally arranged between two clamping rails consisting of flat material, such additional compensation rail having projecting ends overlapping with the ends of the adjacent clamping rails. The mounting holes in the zone of overlap are arranged coinciding. The mounting bolts are designed as threaded bolts. After the clamping rails have been attached, spring rings are mounted on the bolts, and nuts are subsequently screwed on which, by means of a torque wrench, are tightened to a constant clamping tension. Instead of using a screwed connection, it is possible also the clamp the clamping rails and/or the compensating rails tightly by means of eccentric levers secured on the bolts. The top edge of the fastened foil is terminated flush with the top edge of the clamping rails, whereby a sealing compound also may be applied to the edge so formed, the latter extending all around.

A flange extending all around is employed instead of the bolts mainly when above-ground storage tanks made of metal are refitted at a later time. The flange extending all around is formed by individual part pieces, which are joined by butt-welding. The flanges, which are only a few centimeters wide, have a wall thickness equal to or greater than the thickness of the insert forming the hollow space. The wall thickness of the flange has to correspond with the wall thickness of the walls of the tank. The flange may be provided with threaded boreholes for receiving mounting screws, or the flange is equipped with threaded bolts, which are spaced from each other.

The invention is explained in greater detail in the following by reference to the associated drawing, in which.

Figure 1:
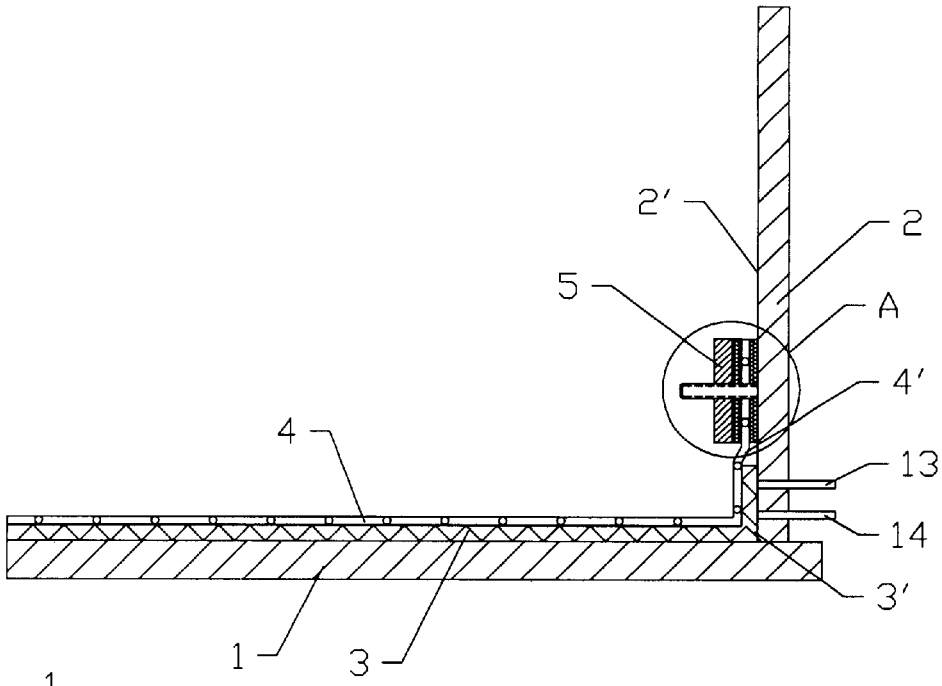
FIG. 1 is a part piece of a schematically shown above-ground storage tank made from steel and having a lining protecting it against leakage, viewed by a longitudinal section.

The above-ground storage tank shown in FIG. 1 is designed single-walled and consists of a tank bottom 1 and the tank wall 2. Such a closed tank is intended, for example, for storing heating oil, and has a diameter of 18 m and a height of 11 m. In addition, the tank has a sealable opening designed as a manhole. before the lining protecting the tank against leakage is installed, the empty tank is cleaned and tank bottom 1 is inspected for tightness and, if necessary, repaired, and provided with a corrosion-inhibiting paint coating or a curable liquid plastic applied as a sealant. A plastic grid 3 consisting of PE-HD is placed on tank bottom 1, such grid having a height of 5 mm. The plastic grid 3 serving as the cavity forming insert covers the entire surface of tank bottom 1, and, starting from tank bottom 1, is extended upwardly for about another 100 mm in the zone of tank wall 2.

Figure 2:
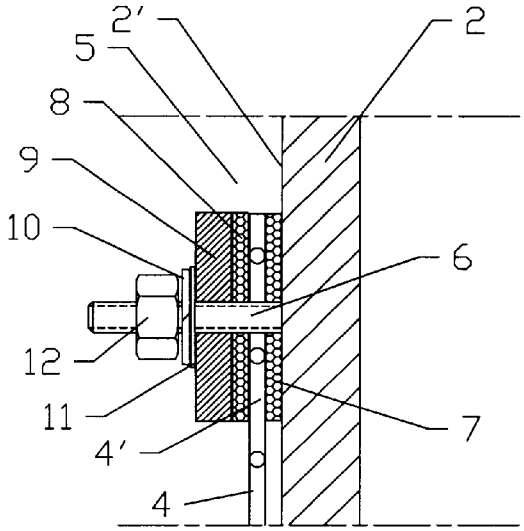
FIG. 2 shows detail "A" according to FIG. 1 by an enlarged representation.

The upper angled section 3' of plastic grid 3, said section extending all around, rests all around against inner side 2' of tank wall 2. A plastic foil 4 consisting of PVC with a thickness of 1.5 mm is placed on insert 3 and, in the zone of inner side 2', is pulled up over section 3' of plastic grid 3. The outer dimensions of plastic foil 4 are by about 250 mm larger than the surface area of tank bottom 1. Foil 4 is secured on the inner side 2' of tank wall 2 by means of a clamping device 5 (FIG.2). For this purpose, threaded steel bolts 6 are welded to inner side 2' of tank wall 2 at a level of about 200 mm above tank bottom 1, said bolts being distributed over the circumference. The steel bolts 6 have a diameter of 10 mm and a length of 60 mm. They are arranged with a spacing of 150 mm from each other and they project into the interior of the tank. In the mounting section 4' of plastic foil 4, said section extending all around, holes are provided with the same spacing as the bolts, so that mounting section 4', of plastic foil 4 can be plugged to the bolts free of folds. However, a first elastic sealing strip 7, which is coated with adhesive on both sides and extends all around, is first mounted on the bolts 6 and solidly glued with its outer side to inner side 2' of tank wall 2. The elastic sealing strip may consist of, for example, polyurethane, and has a thickness of 5 mm and a width of about 80 mm. After the sealing tape 7 has been mounted on inner side 2' of tank wall 2, the protective film is pulled step by step from the inner side of sealing tape 7, and foil 4 is mounted on the bolts and secured by gluing on sealing tape 7. When gluing on the foil 4 it has to be made sure that no folds are formed. The outer edge of foil 4 has to terminate flush with the upper edge of sealing tape 7. A second sealing tape 8 is glued to the glued-on foil 4, said tape 8 being designed analogous to the first sealing tape 7. The two sealing tapes 7 and 8 are already provided with prepared holes, which are arranged in accordance with the spacing of mounting bolts 6. Subsequently, the clamping rails 9 are mounted on bolts 6, whereby the length of clamping rails 9 is dimensioned in such a way that said rails extend over a plurality of bolts 6. The adjacent clamping rails 9 have to abut each other with their narrow face sides. The clamping rails 9 are made of steel and have a width of 80 mm and a thickness of 8 mm, as well as correspondingly spaced holes for plugging the rails to the bolts 6. After the clamping rails 9 have been mounted, spring rings 10 are mounted on the projecting bolts 6, and a washer 11 is mounted on each of said spring rings. Thereafter, the screws 12 are screwed to the threaded bolts 6 and tightened with a torque wrench, whereby a constant clamping tension is adjusted for all screw connections.

The foil located between the two sealing tapes 7 and 8, as well as the sealing tapes 7 and 8 are solidly pressed against the inside 2' of tank wall 2 by the clamping rails 9 and the clamping tension acting on said rails. Thus, a medium- and vacuum-tight connection is established between inside wall 2', sealing tapes 7 and 8, as well as the clamping rails 9. Below clamping device 5, provision is made in tank wall 2 for the boreholes required for arranging the vacuum measuring line 13 and the vacuum test line 14. The thickness of the walls of clamping rails 9 is dimensioned in such a way that said thickness is equal to or greater than the thickness of tank wall 2.

Figure 3:
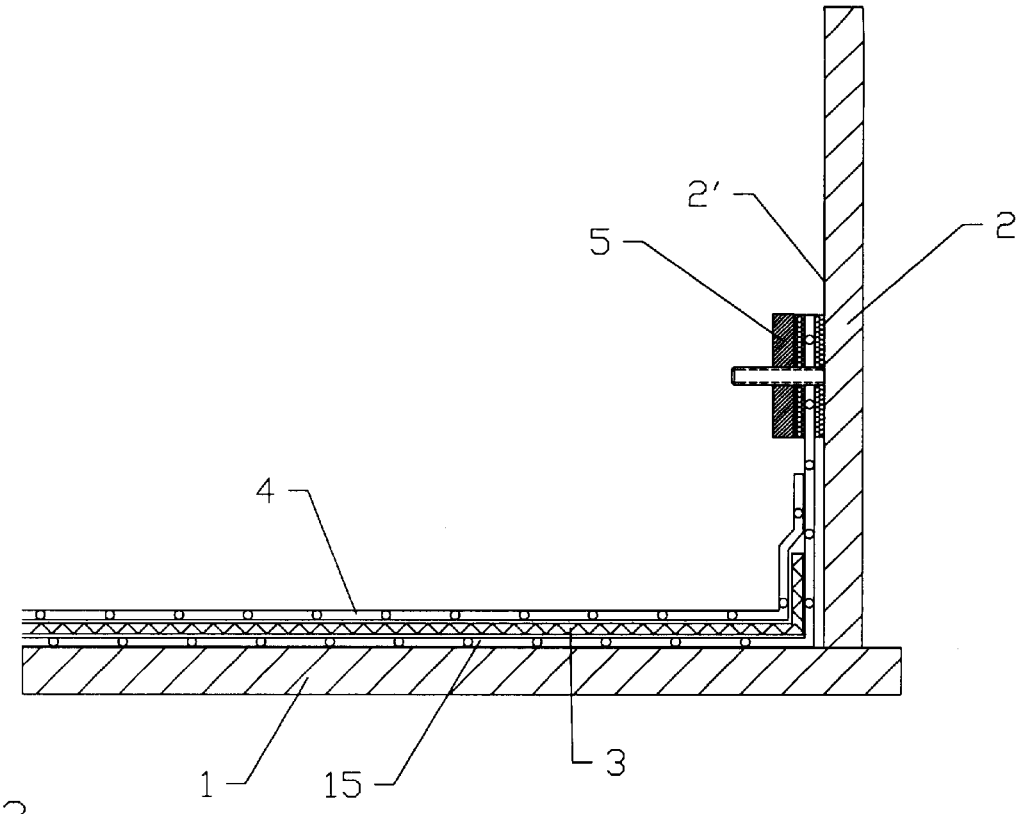
FIG. 3 is another design variation of a schematically shown above-ground storage tank made of steel and having a lining for protecting it against leakage, viewed by a longitudinal section.

As compared to the variation according to FIGS. 1 and 2, the design variation illustrated in FIG. 3 shows that a plastic foil 15 is additionally placed directly on tank bottom 1 in the latter, which, in the region below clamping device 5, is joined by welding with foil 4 resting on plastic grid 3. Plastic grid 3 is arranged between the two foils 15 and 4 for forming the leakage monitoring space. This design is employed particularly if the existing tank bottom already had leaky spots before it is restored, or if particularly high safety-technical requirements have to be met in view of the fluid to be stored in the tank.

Foil 4 is secured on the inner wall of the tank analogous to the design according to FIGS. 1 and 2.

Figure 4:
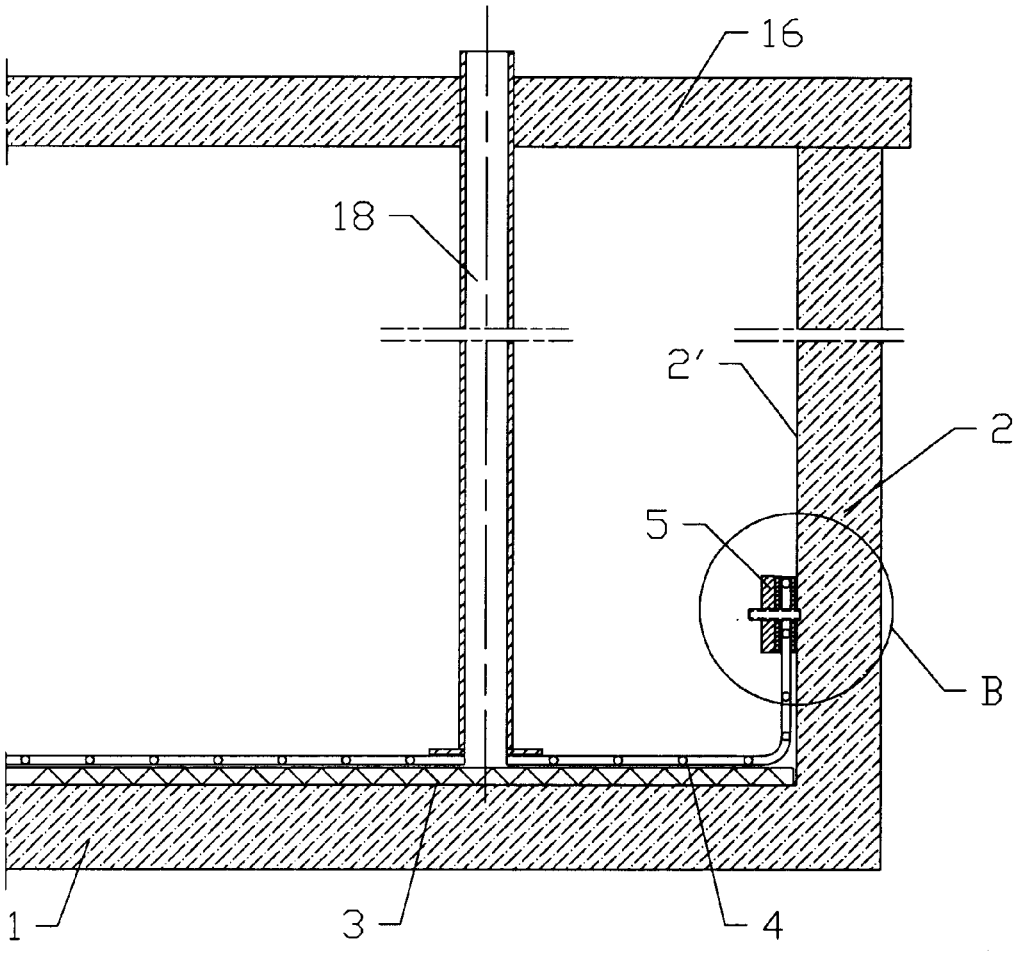
FIG. 4 is a longitudinal sectional view of a part piece of a schematically shown above-ground storage tank with a lining protecting it against leakage.

FIG. 4 shows a part piece of an above-ground storage tank made from reinforced concrete. Such a tank has a height of, for example, 8 meters, and is covered by a tank cover 16 resting on the side walls 2. After tank bottom 1 has been restored, it is lined with a plastic grid 3 having a height of 5 mm, said plastic grid completely covering tank bottom 1. A medium-resistant plastic sheet 4 is placed on plastic grid 3. On the inner sides 2' of tank wall 2, said plastic sheet 4 extends upwardly up to a spacing of about 400 mm from tank bottom 1.

Figure 5:
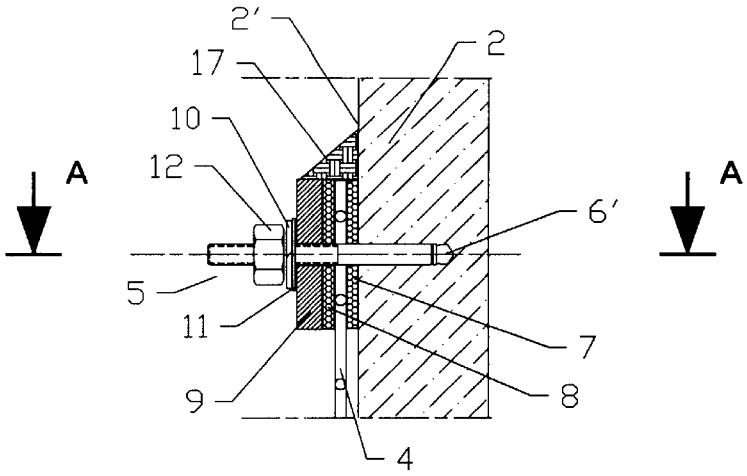
FIG. 5 shows an enlarged view of detail "B" according to FIG. 4.
Figure 6:
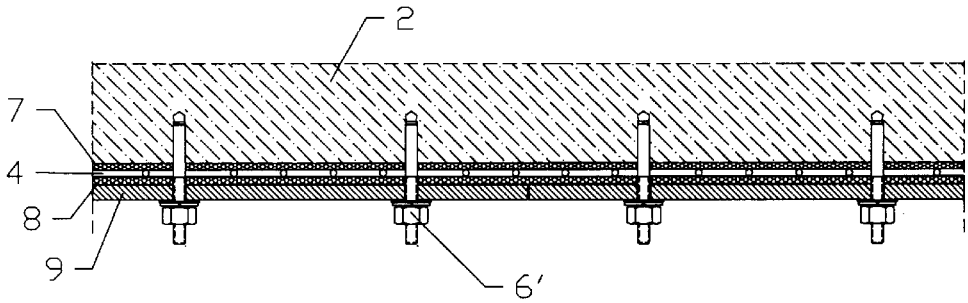
FIG. 6 is a section according to line A—A in FIG. 5.

Clamping device 5, for securing plastic sheet 4, is designed on inner side 2' of tank wall 2 substantially analogous to the clamping devices described in the foregoing. In the corner areas, the clamping rails are designed as angle rails. Since tank wall 2 consists of reinforced concrete, fastening bolts 6' are glued into corresponding boreholes of tank wall 2 (FIG. 5). Threaded bolts 6', which are made of steel, have a length of 100 mm and a diameter of 8 mm. After threaded bolts 6' have been glued into tank wall 2, they project about 50 mm into the interior of the tank. Threaded bolts 6' all are arranged with equal spacings from tank bottom 1, such spacing amounting to 400 mm. The spacing between the individual threaded bolts 6' comes to 145 mm in each case. A sealing compound 17 is applied directly to the upper edge of clamping device 5, said edge being formed by the clamping rails 9, the sealing tapes 7 and 8, as well as by the foil 4 installed between sealing tapes 7 and 8. A riser 18 made of plastic is welded into plastic foil 4, said riser extending to the top through tank cover 16. A measuring sensor of the type known per se is installed in said riser 18. Said sensor detects any leakage caused by untight spots in foil 4 and indicates such leakage on a measuring instrument arranged outside of the tank.

Figure 7:
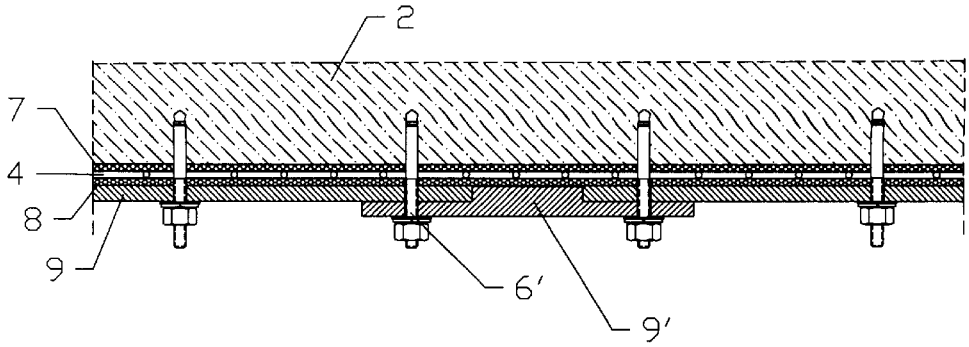
FIG. 7 shows a longitudinal sectional view of another design variation of the clamping rails.
Figure 8:
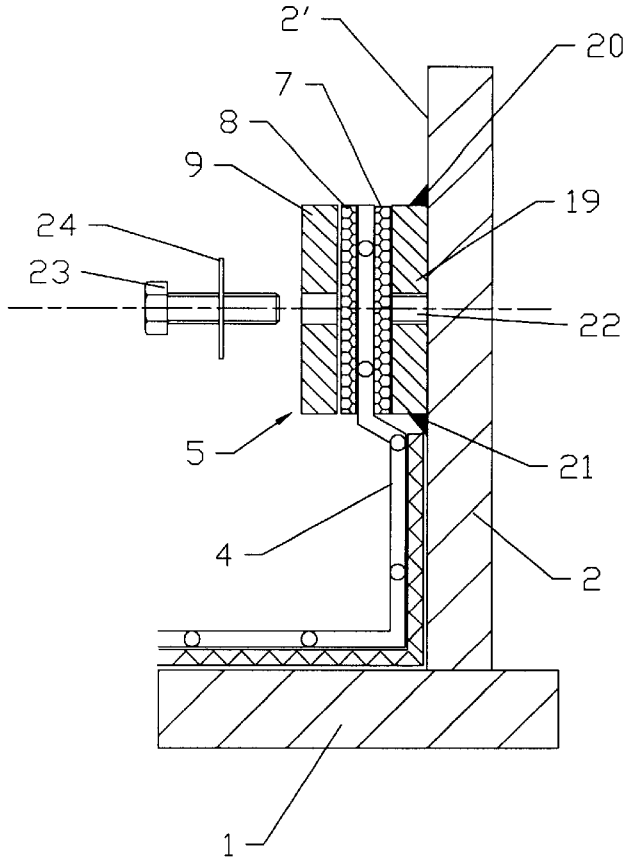
FIG. 8 is a longitudinal sectional view of a part component of a schematically shown above-ground storage tank made from steel and having a leakage protection lining mounted on a flange.

FIG. 7 shows a further design and arrangement of the clamping rails. Clamping rails 9 extend here over a plurality of bolts 6' and are plugged onto the latter. A defined s pacing exists between two adjacent clamping rails 9 in the circumferential direction. A compensating rail 9' with two steps is precisely fitted in said free space, whereby the ends of compensating rails 9' overlap the adjacent clamping rails 9. The length of compensating rails 9' is greater than the spacing between two bolts 6', and the mounting holes of the clamping rails 9 and of the compensating rails 9' coincide.

Figure 9:
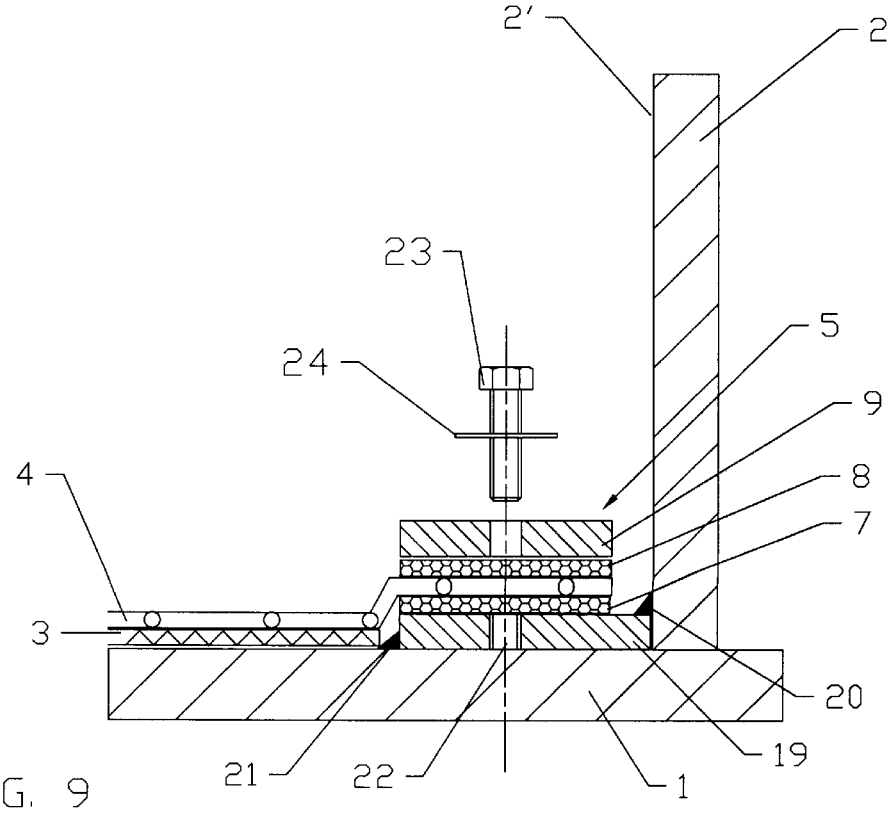
FIG. 9 is a longitudinal sectional view of a part component of a schematically shown above-ground storage tank made of steel and having a leakage protection lining of the tank bottom secured on a flange.

As opposed to the design variations shown in FIGS. 1 to 7, FIGS. 8 and 9 show design variations where the system for mounting the leakage protection lining is formed not by bolts, but by a flange 19 extending all around. The circumferential flange 19 consists of a plurality of identical part pieces, which are butt-welded to the inner side 2' of tank wall 2, in each case, in such a manner that flange 19 is secured medium-tight. Positions 20, 21 characterized the two welding seams. The welded-on flange 19 has a wall thickness of approximately 30 mm and a width of 80 mm. In the center of flange 19, provision is made for threaded boreholes 22 spaced 150 mm from each other for receiving the threaded bolts 23 with spring rings 24 for securing foil 4 by means of clamping rails 9. In the variation shown in FIG. 8, flange 19 is arranged at the same level as the bolts 6 according to FIGS. 1 to 7. FIG. 9 shows a variation where the leakage protection lining only covers the bottom 1 of the tank. A circumferential flange 19 consisting of a plurality of identical part pieces is located on the outer limitation of tank bottom 1 and thus in the direct proximity of tank wall 2, or resting against tank wall 2, said flange being welded to the bottom and to tank wall 2. The welded spots are denoted by reference numerals 20 and 21. Plastic grid 3, in each case extends up to welding seam 21, disposed on the inside and covers the area of tank bottom 1 encircled by the circumferential flange 19. As described in detail already above, foil 4 is joined with flange 19 between the sealing tapes 7 and 8, as well s the attached circumferential clamping rail 9 in a medium-tight manner by tightening threaded bolts 23—which are under spring tension supplied by spring rings 24—with a defined torque. The small gap between inner side 2' of tank wall 2 and clamping device 5 can be either filled with a curable liquid plastic or sealed in some other known way. In cases where the circumferential flange 19 is required to have only a low wall thickness, said flange can be provided with screw bolts arranged all around, on which the clamping device 5 is then secured.

What is claimed is:

1. A flat-bottom tank with leakage protection lining, wherein said tank has a bottom and a tank wall comprising the following:

at least one pressure-stable insert (3) forming a hollow space, said insert extending from the bottom of the tank up to a lower zone of an inner side (2') of the tank wall (2);

a first media-resistant foil (4) made of plastic, said foil resting on said insert (3) and being located in a lower zone of the inner side of the tank wall (2);

a clamping device (5) for securing the foil (4) all around with a small spacing from the tank bottom (1), wherein the pressure-stable insert (3) covers the tank bottom (1) and maximally extends up to the clamping device (5), said clamping device comprising:

a flange (19) extending all around with a slight spacing from the tank bottom and being connected with the tank wall (2) in a fixed manner by an upper and lower welding seam, said flange comprised of several parts welded to the tank wall (2) butt to butt;

at least one clamping rail (9, 9') adapted to be screwed to the flange (19) and locked on the flange (19) under pressure tension;

inwardly projecting bolts (6, 6') secured on the flange at defined intervals for receiving the clamping rails (9, 9') and elastic sealing strips (7, 8) extending all around, said sealing strips being arranged between said at least one clamping rail (9, 9') and the foil (4), as well as between the foil (4) and an inner,side of the flange (19), wherein a sealing compound (17) is applied to an upper edge, said edge being formed by said at least one clamping rail (9, 9'), said flange and the glued-on foil (4) as well as the sealing strips (7, 8).

2. The flat-bottom tank according to claim 1, further comprising threaded bores (22) arranged in the flange for receiving fastening screws (23) for locking the clamping rails.

3. The flat-bottom tank according to claim 1, wherein the bolts (6, 6') are threaded steel bolts welded to the inner side of the flange (19).

4. The flat-bottom tank according to claim 1, wherein the bolts (6, 6') are threaded steel bolts glued into the flange (19).

5. The flat-bottom tank according to claim 1, wherein the sealing strips (7, 8) are coated with adhesive at least on one longitudinal side.

6. The flat-bottom tank according to claim 1, wherein the sealing strips (7, 8) are coated with a sealing compound at least on one side.

7. A flat-bottom tank with leakage protection lining, said tank having a bottom and a tank wall comprising the following:

at least one pressure-stable insert (3) covering the tank bottom (1) and forming a hollow space;

a media-resistant foil (4) made of plastic and resting on said insert (3), wherein the foil (4) almost completely covers the tank bottom (1) and is secured all around on an outer limitation of the tank bottom (1) by means of a clamping device (5) comprising the following:

a flange (19) extending all around, said flange being connected in a fixed manner with the tank bottom (1) and the tank wall (2);

at least one clamping rail (9, 9') adapted to be screwed to the flange (19) and locked on the flange (19) under pressure tension; and elastic sealing strips (7, 8) extending all around, said sealing strips being arranged between said at least one clamping rail (9, 9') and the foil (4) as well as between the foil (4) and an inner side of the flange (19).

8. The flat-bottom tank according to claim 7, further comprising threaded bores (22) arranged in the flange for receiving fastening screws (23) for locking the clamping rails (9, 9').

9. The flat-bottom tank according to claim 7, further comprising inwardly projecting bolts (6, 6') secured on the flange at defined intervals for receiving the clamping rails (9, 9').

10. The flat-bottom tank according to claim 9, wherein the bolts (6, 6') are threaded steel bolts welded to the inner side of the flange (19).

11. The flat-bottom tank according to claim 9, wherein the bolts (6, 6') are threaded steel bolts glued into the flange (19).

12. The flat-bottom tank according to claim 7, wherein the flange (19) extending all around is comprised of several parts welded to the tank bottom (1) and the tank wall (2) butt to butt.

13. The flat-bottom tank according to claim 7, wherein the sealing strips (7, 8) are coated with adhesive at least on one longitudinal side.

14. The flat-bottom tank according to claim 7, wherein the sealing strips (7, 8) are coated on at least one side with a sealing compound.

15. A method for equipping a flat-bottom tank with a leakage protection lining consisting of at least one media-resistant foil made of plastic, comprising the following steps:

(a) fastening a flange extending all around with a slight spacing from the tank bottom on an inner side of the tank so as to be media resistant and for receiving one or more clamping rails (9, 9'), said flange being connected with the inner side of the tank in a fixed manner by an upper and lower welding seam, said flange being comprised of several parts welded to the tank wall (2) butt to butt;

(b) securing inwardly projecting bolts (6, 6') on the flange at defined intervals;

(c) placing an insert (3) on the tank bottom (1), said insert covering at least the tank bottom (1) and forming a hollow space;

(d) fastening a first elastic sealing strip (7) extending all around near the flange (19), the sealing strip (7) resting tightly against an inner side of the flange (19);

(e) preparing at least one plastic foil (4) in the form of a cut with dimensions corresponding with the inner side of the tank to be lined;

(f) securing the plastic foil (4) on the first sealing strip (7) free of folds and flush with a top edge of the sealing strip;

(g) gluing to or placing on the plastic foil (4) a second sealing strip (8) congruent to the first sealing strip (7);

(h) mounting at least one clamping rail (9, 9') all around on the flange (19) and fastening the at least one clamping rail (9, 9') on the flange (19) by means of screw connections (10, 11, 12, 23, 24) with adjustment of a uniformly defined clamping tension, by which the foil (4) is pressed media-tight against an inner Side of the flange (19);

(i) applying a sealing compound (17) to an upper edge, said edge being formed by said at least one clamping rail (9, 9'), said flange and the glued-on foil (4) as well as the sealing strips (7, 8) and (j) installing a leakage monitoring device.

16. The method according to claim 15, wherein the flange (19) is secured on an outer limitation of the tank bottom (1).

17. The method according to claim 15, wherein the bolts (6, 6') are welded to the flange (19).

18. The method according to claim 15, wherein the bolts (6, 6') are glued into the flange (19).

* * * * *